US007717283B2

(12) United States Patent
Apps et al.

(10) Patent No.: US 7,717,283 B2
(45) Date of Patent: May 18, 2010

(54) COLLAPSIBLE CONTAINER

(75) Inventors: William P. Apps, Alpharetta, GA (US); Mauricio D. Cavalcante, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 267 days.

(21) Appl. No.: 11/936,032

(22) Filed: Nov. 6, 2007

(65) Prior Publication Data

US 2009/0114647 A1 May 7, 2009

(51) Int. Cl.
*B65D 8/14* (2006.01)

(52) U.S. Cl. ..... 220/6; 206/506

(58) Field of Classification Search ..... 220/4.28, 220/6, 7, 653; 206/506
See application file for complete search history.

(56) References Cited

U.S. PATENT DOCUMENTS

| | | | |
|---|---|---|---|
| 1,689,217 | A | 10/1928 | White |
| 1,809,523 | A | 6/1931 | McLean |
| 2,134,875 | A | 11/1938 | Henze |
| 2,760,669 | A | 8/1956 | Kreutzer |
| 3,220,603 | A | 11/1965 | Bromley |
| 3,360,180 | A | 12/1967 | Venturi |
| 3,446,415 | A | 5/1969 | Bromley |
| 3,591,212 | A | 7/1971 | Rhyne |
| 3,853,238 | A | 12/1974 | Luisada et al. |
| 3,874,546 | A | 4/1975 | Sanders et al. |
| 3,951,265 | A | 4/1976 | Carroll |
| 4,106,623 | A | 8/1978 | Carroll |
| 4,109,791 | A | 8/1978 | Clipson et al. |
| 4,148,407 | A | 4/1979 | Sinclair |
| 4,241,831 | A | 12/1980 | Locatelli |
| 4,247,004 | A | 1/1981 | Bird |
| 4,391,369 | A | 7/1983 | Stahl et al. |
| 4,423,813 | A | 1/1984 | Kreeger et al. |
| 4,466,541 | A | 8/1984 | Tabler et al. |
| 4,573,577 | A | 3/1986 | Miller |
| 4,591,065 | A | 5/1986 | Foy |
| RE32,223 | E | 8/1986 | Kreeger et al. |
| 4,643,310 | A | 2/1987 | Deaton |
| 4,735,330 | A | 4/1988 | Hoss |

(Continued)

FOREIGN PATENT DOCUMENTS

| | | |
|---|---|---|
| CA | 2309234 | 11/2000 |

(Continued)

OTHER PUBLICATIONS

European Search Report for EP Application No. 08168414.4, Feb. 23, 2009.

(Continued)

*Primary Examiner*—Anthony Stashick
*Assistant Examiner*—Harry A Grosso
(74) *Attorney, Agent, or Firm*—Carlson, Gaskey & Olds

(57) ABSTRACT

A collapsible container includes a plurality of walls collapsible onto the base. At least one wall has a support pivotably mounted below a lip formed on an upper edge of the wall. The support is pivotable between a support position where it is partially supported on an adjacent wall and a retracted position. A stop on the adjacent wall prevents the support from retracting when another container is stacked thereon.

19 Claims, 9 Drawing Sheets

U.S. PATENT DOCUMENTS

| | | | |
|---|---|---|---|
| 4,759,451 | A | 7/1988 | Apps |
| 4,848,578 | A | 7/1989 | Schafer |
| 4,863,062 | A | 9/1989 | Holliday |
| 4,887,874 | A | 12/1989 | Joffe |
| 4,901,859 | A | 2/1990 | Jones |
| 4,905,833 | A | 3/1990 | Kreeger et al. |
| 4,917,255 | A | 4/1990 | Foy et al. |
| 4,923,079 | A | 5/1990 | Foy |
| 4,947,992 | A | 8/1990 | Schafer |
| 4,960,223 | A | 10/1990 | Chiang et al. |
| 5,083,666 | A | 1/1992 | Lam |
| 5,094,356 | A | 3/1992 | Miller |
| 5,161,709 | A | 11/1992 | Oestreich, Jr. |
| 5,332,114 | A | 7/1994 | Sano et al. |
| 5,398,834 | A | 3/1995 | Umiker |
| 5,398,835 | A | 3/1995 | Blinstrub |
| 5,467,885 | A | 11/1995 | Blinstrub |
| 5,494,163 | A | 2/1996 | Apps |
| 5,515,987 | A | 5/1996 | Jacques et al. |
| 5,586,675 | A | 12/1996 | Borsboom et al. |
| 5,588,549 | A | 12/1996 | Furtner |
| 5,609,254 | A | 3/1997 | Loftus |
| 5,632,392 | A | 5/1997 | Oh |
| D381,203 | S | 7/1997 | Ackermann |
| 5,671,857 | A | 9/1997 | Stromberg |
| 5,772,033 | A | 6/1998 | Loftus |
| 5,797,508 | A | 8/1998 | Loftus et al. |
| 5,853,099 | A | 12/1998 | Lessard |
| 5,860,527 | A | 1/1999 | Frankenberg et al. |
| 5,924,572 | A | 7/1999 | Cope |
| 5,975,324 | A | 11/1999 | Schmitt |
| 6,015,056 | A | 1/2000 | Overholt et al. |
| 6,029,840 | A | 2/2000 | Brauner |
| 6,056,177 | A | 5/2000 | Schneider |
| 6,059,114 | A | 5/2000 | Loftus |
| 6,073,790 | A | 6/2000 | Umiker |
| 6,082,570 | A | 7/2000 | Tai |
| 6,098,827 | A | 8/2000 | Overholt et al. |
| 6,142,329 | A | 11/2000 | Dotan |
| 6,179,156 | B1 | 1/2001 | Aiken |
| 6,209,742 | B1 | 4/2001 | Overholt et al. |
| D446,392 | S | 8/2001 | Overholt et al. |
| 6,286,701 | B1 | 9/2001 | Umiker |
| 6,290,081 | B1 | 9/2001 | Merey |
| 6,293,418 | B1 | 9/2001 | Ogden et al. |
| D452,614 | S | 1/2002 | Overholt |
| 6,382,458 | B2 | 5/2002 | Mori |
| 6,386,388 | B1 | 5/2002 | Overholt |
| D458,753 | S | 6/2002 | Overholt et al. |
| 6,398,054 | B1 | 6/2002 | Overholt |
| 6,405,888 | B1 | 6/2002 | Overholt et al. |
| 6,409,041 | B1 | 6/2002 | Overholt et al. |
| 6,446,825 | B1 | 9/2002 | Godoy |
| 6,581,330 | B1 | 6/2003 | Helsloot et al. |
| 6,722,516 | B1 | 4/2004 | Zelko |
| 6,772,897 | B2 | 8/2004 | Kellerer et al. |
| 6,863,180 | B2 | 3/2005 | Apps et al. |
| 6,994,216 | B2 | 2/2006 | Wong |
| 7,017,766 | B2 | 3/2006 | Hsu et al. |
| 7,195,128 | B2 | 3/2007 | Murakami et al. |
| 2002/0108950 | A1 | 8/2002 | Moorman et al. |
| 2003/0000950 | A1 | 1/2003 | Murakami et al. |
| 2003/0132228 | A1 | 7/2003 | Apps et al. |
| 2003/0222081 | A1 | 12/2003 | Apps et al. |
| 2004/0069780 | A1 | 4/2004 | Apps et al. |
| 2004/0129700 | A1 | 7/2004 | Oster et al. |
| 2005/0040166 | A1* | 2/2005 | Nolet et al. ..... 220/6 |
| 2005/0098556 | A1 | 5/2005 | Kellerer |
| 2007/0095842 | A1 | 5/2007 | Apps et al. |
| 2007/0125779 | A1* | 6/2007 | Cope ..... 220/6 |

FOREIGN PATENT DOCUMENTS

| | | |
|---|---|---|
| DE | 1536040 | 12/1969 |
| DE | 2033724 | 7/1970 |
| DE | 3511321 | 10/1986 |
| DE | 3521894 | 1/1987 |
| DE | 9103975 | 3/1991 |
| DE | 19939019 | 8/1999 |
| DE | 20002537 | 2/2000 |
| EP | 0073357 | 3/1983 |
| EP | 0299657 | 7/1988 |
| EP | 0341074 | 5/1989 |
| EP | 0385914 | 9/1990 |
| EP | 0404041 | 12/1990 |
| EP | 0690003 | 1/1996 |
| EP | 0705764 | 4/1996 |
| EP | 0785142 | 7/1997 |
| EP | 0962394 | 12/1999 |
| EP | 0962396 | 12/1999 |
| EP | 1114779 | 7/2001 |
| EP | 1160169 | 12/2001 |
| EP | 1182139 | 2/2002 |
| EP | 1241105 | 9/2002 |
| EP | 1 785 360 | 5/2007 |
| EP | 2 003 062 | 12/2008 |
| FR | 1040163 | 10/1953 |
| FR | 2701690 | 2/1993 |
| FR | 2702198 | 3/1993 |
| GB | 1215049 | 12/1970 |
| GB | 2068338 | 8/1981 |
| GB | 2129401 | 5/1984 |
| GB | 2139189 | 11/1984 |
| GB | 2141778 | 1/1985 |
| GB | 2171980 | 9/1986 |
| GB | 2431921 | 5/2007 |
| GB | 2431922 | 5/2007 |
| JP | 11222233 | 8/1999 |
| JP | 2001180670 | 7/2001 |
| JP | 20030220037 | 1/2003 |
| NL | 7905105 | 6/1979 |
| SU | 1533952 | 1/1990 |
| WO | 93/24378 | 12/1993 |
| WO | 97/49613 | 12/1997 |
| WO | 98/56668 | 12/1998 |
| WO | 00/27716 | 5/2000 |
| WO | 00/66440 | 11/2000 |
| WO | 02/06128 | 1/2002 |
| WO | 02/34630 | 5/2002 |
| WO | 03/104094 | 12/2003 |

OTHER PUBLICATIONS

Decision on Appeal for U.S. Appl. No. 11/264,371 mailed on May 11, 2009.

* cited by examiner

COLLAPSIBLE CONTAINER

BACKGROUND OF THE INVENTION

The present invention relates generally to collapsible crates and more particularly to a collapsible crate with support members for supporting another container thereon.

Collapsible crates are well known. Four walls each connected via a hinge to a base are selectively movable about the hinge between a use position, in which the wall is generally perpendicular to the base, and a collapsed position onto the base. Various latch mechanisms have been provided to connect adjacent walls at the corner to selectively lock the crate in the use position.

Some collapsible crates also include retractable supports so that another container can be supported thereon. One such crate includes end walls each having a support that is partially supported on the adjacent walls when in the support position. However, the support can be knocked from a support position back into the retracted position by the container being stacked thereon. This is inconvenient for the user, who has to reposition the support and re-stack the upper container more carefully.

SUMMARY OF THE INVENTION

The present invention provides a collapsible container having a plurality of walls collapsible onto the base. At least one wall has a support pivotably mounted below an upper end thereof. The support is pivotable between a support position where it can support another container thereon and a retracted position against the wall. In the support position, the lateral ends of the support are supported on the long walls. A stop is formed on the long wall to inhibit movement of the support out of the support position when another container is stacked thereon. In order to move the support out of the support position, the support must first be lifted over the stop.

In the particular embodiment shown, the supports are formed on short end walls of the container, such that the supports and end walls can be collapsed onto the base and the long side walls can be pivoted onto the end walls. Alternatively, the supports could be formed on the long walls (or on equally-sized walls).

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
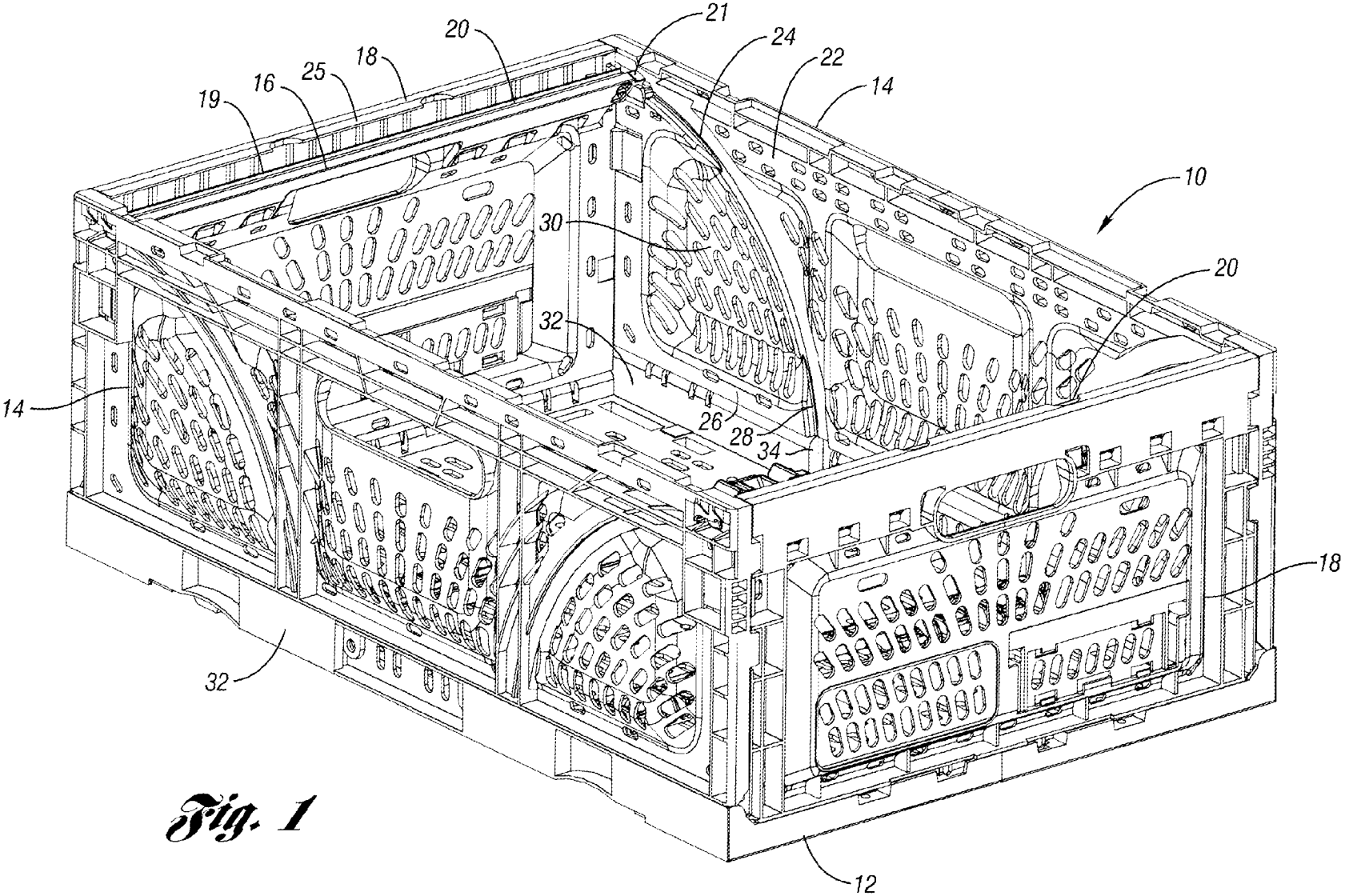
FIG. 1 is a perspective view of the crate according to one embodiment of the present invention.

FIG. 1 is a perspective view of a container 10. The container 10 includes a base 12, upstanding side walls 14 (or long walls) and upstanding end walls 18 (or short walls). The side walls 14 and end walls 18 are pivotably connected along long and short edges of the base 12, respectively.

Each end wall 18 has a support 20. The support 20 is pivotably mounted at its lower edge to a position spaced below an upper edge of the end wall 18. The support 20 is shown in FIG. 1 pivoted to a support position, where it projects into the interior of the container 10 where it can support another container stacked thereon. The supports 20 each include a tab 21 projecting from each side into the adjacent side wall 14. The end walls 18 each include a lip 25 protruding inwardly from the uppermost edge above the support 20.

Figure 2:
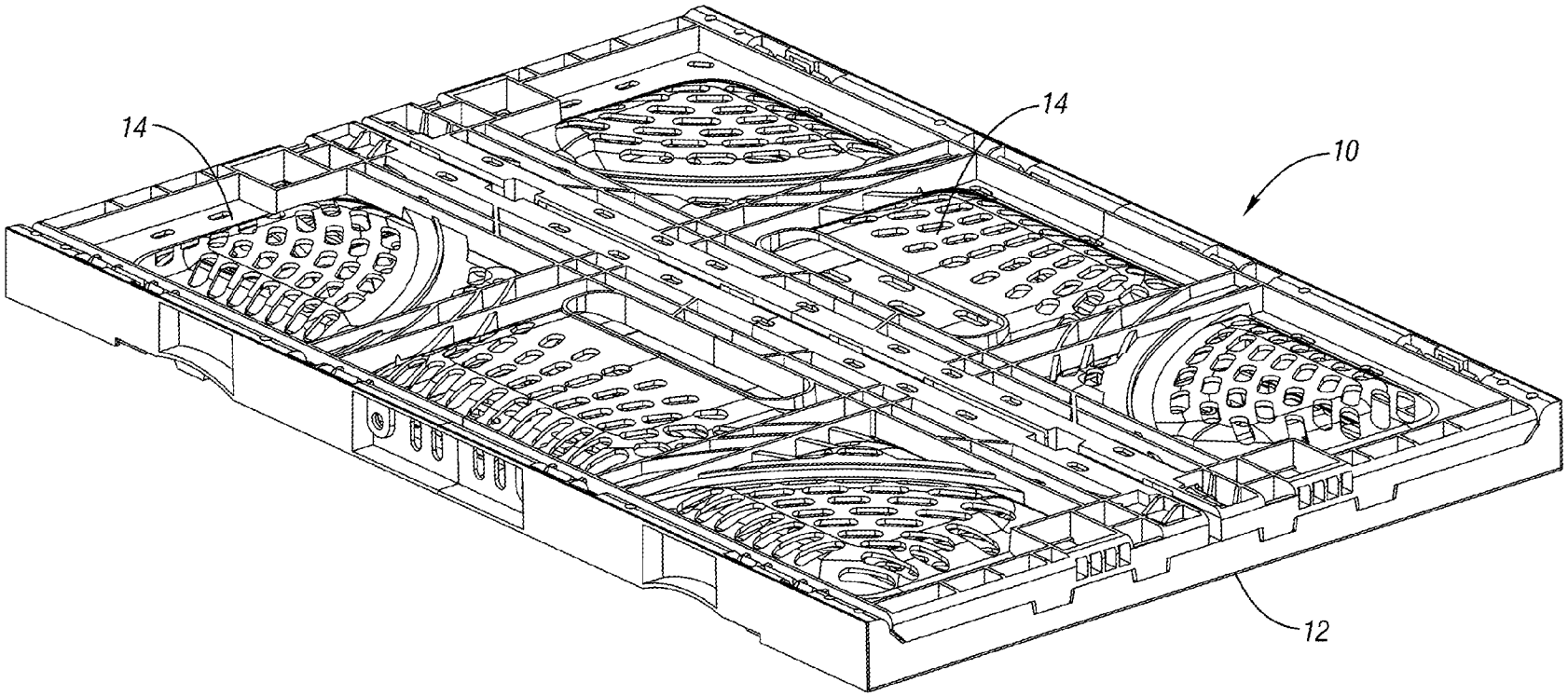
FIG. 2 is a perspective view of the crate in a collapsed position.

The interiors of the side walls 14 each include an upper frame portion 22 protruding into the container 10. A curved channel 24 is formed through each upper frame portion 22 adjacent the end wall 18. The interior of each side wall 14 further includes a lower frame portion 26 having a channel 28 formed therethrough below each curved channel 24. A recess 30 is defined between the upper frame portion 22 and the lower frame portion 26. The base 12 includes a pair of side upstanding portions 32 to which the side walls 14 are pivotably attached. Each side upstanding portion 32 includes a channel 34 formed on an interior thereof, below each channel 28. The channels 24, 28 and 34 are aligned with one another and with the tabs 21 on the supports 20, so that the end walls 18 can be pivoted to the collapsed position prior to the side walls 14 being collapsed, such that the side walls 14 are collapsed onto the end walls 18, as shown in FIG. 2.

Figure 3:
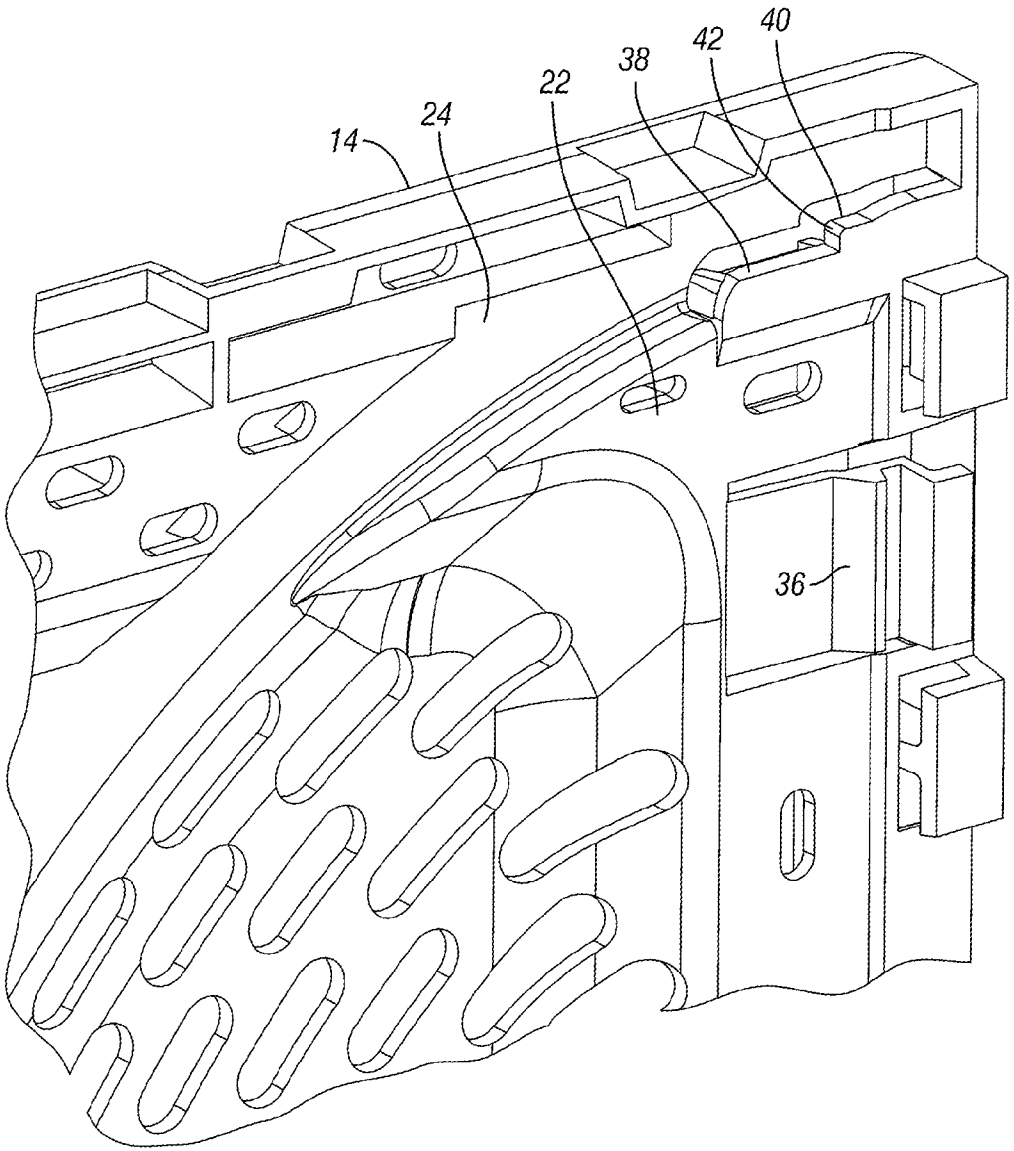
FIG. 3 is an interior perspective view of one end of one of the side walls.

FIG. 3 illustrates one end of one of the side walls 14. Each end of the side wall 14 includes a latch 36. At the top of the curved channel 24 is a rail 38 spaced inwardly into the container 10. The rail 38 includes a step 40 having a substantially vertical leading face 42. The leading face 42 forms a stop, which will be explained below.

Figure 4:
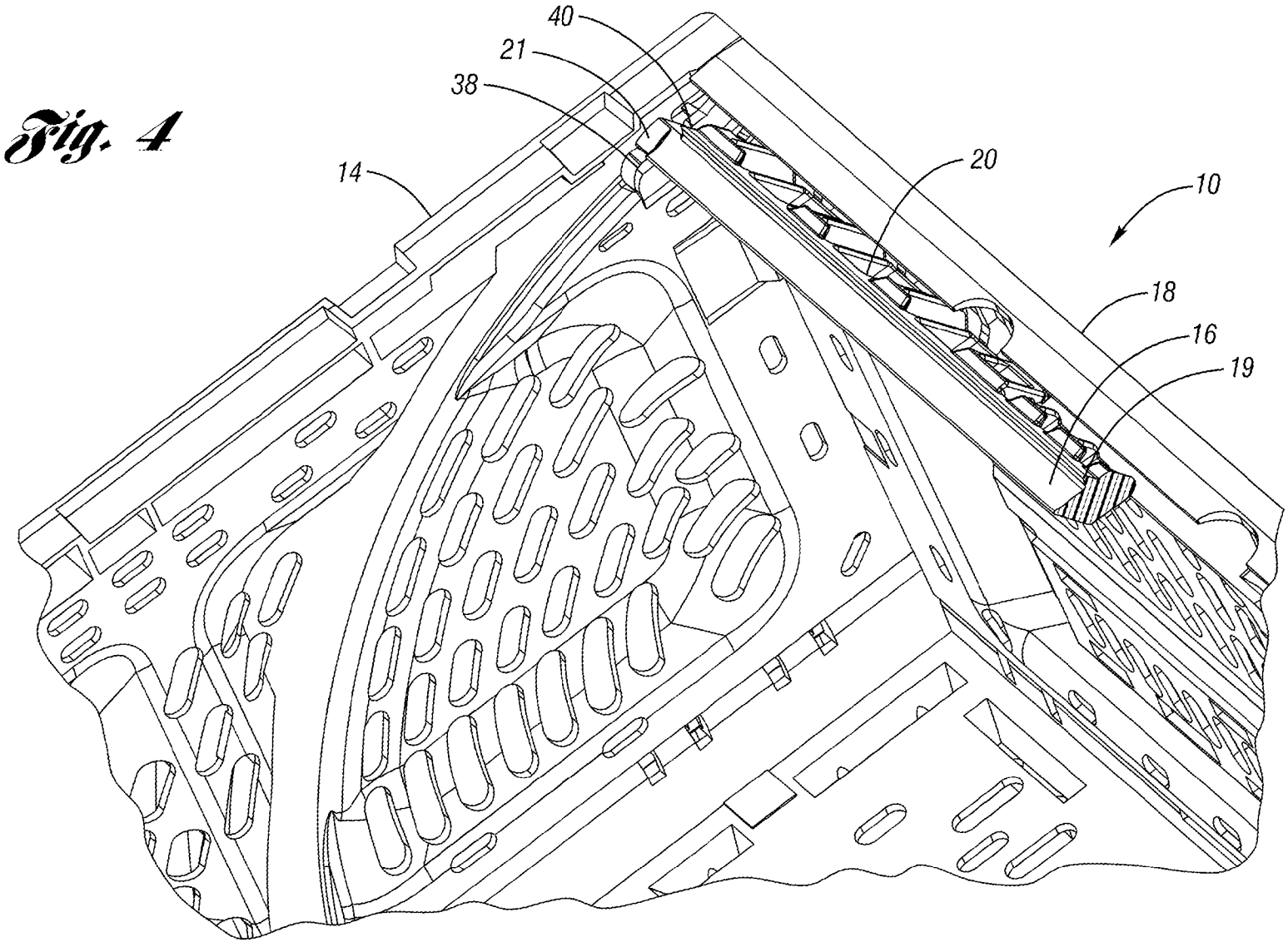
FIG. 4 is a perspective view of one end of the container of FIG. 1, with the support partially broken away.
Figure 5:
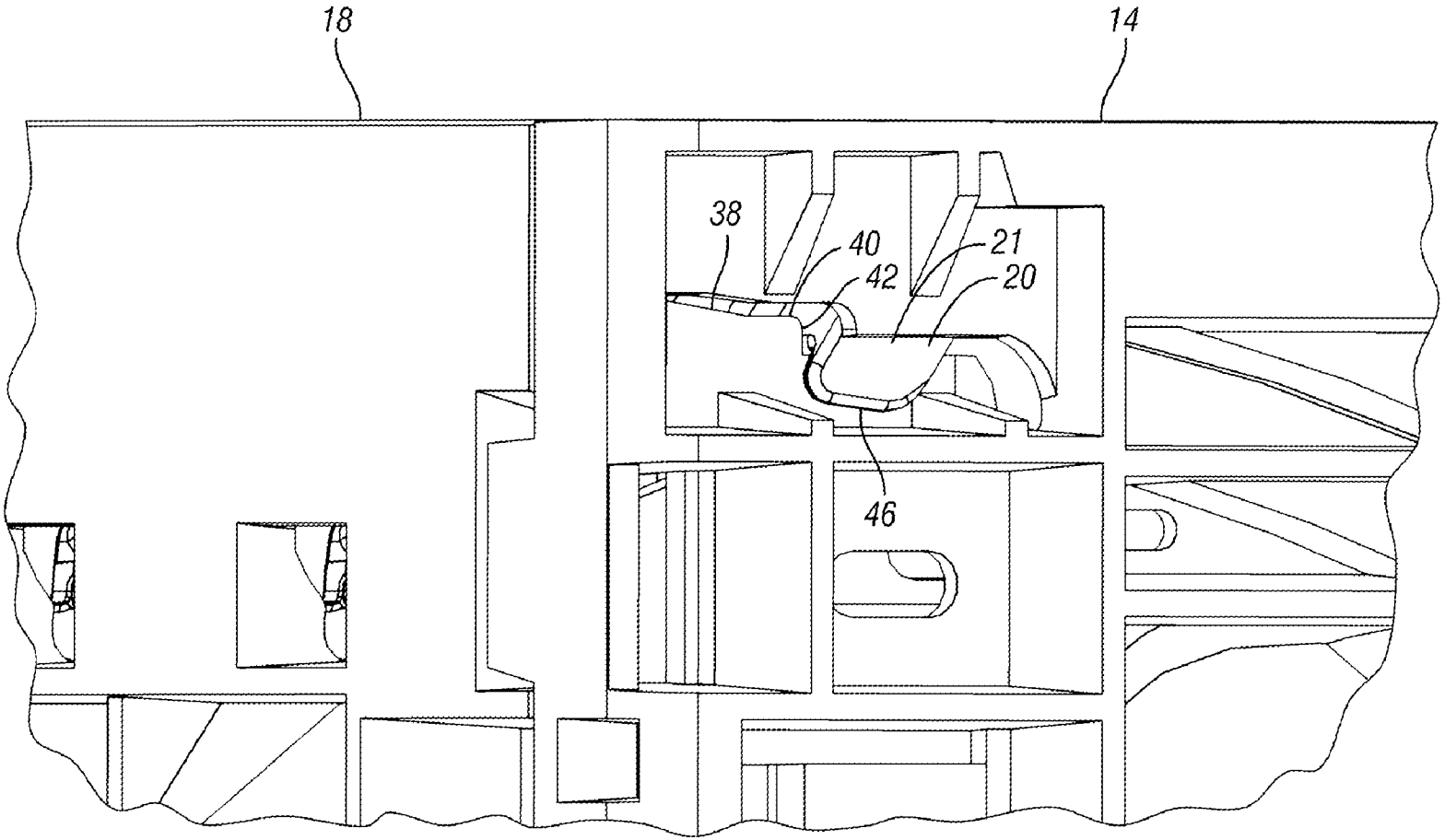
FIG. 5 is an exterior view of one corner of the container with the support in the support position.
Figure 6:
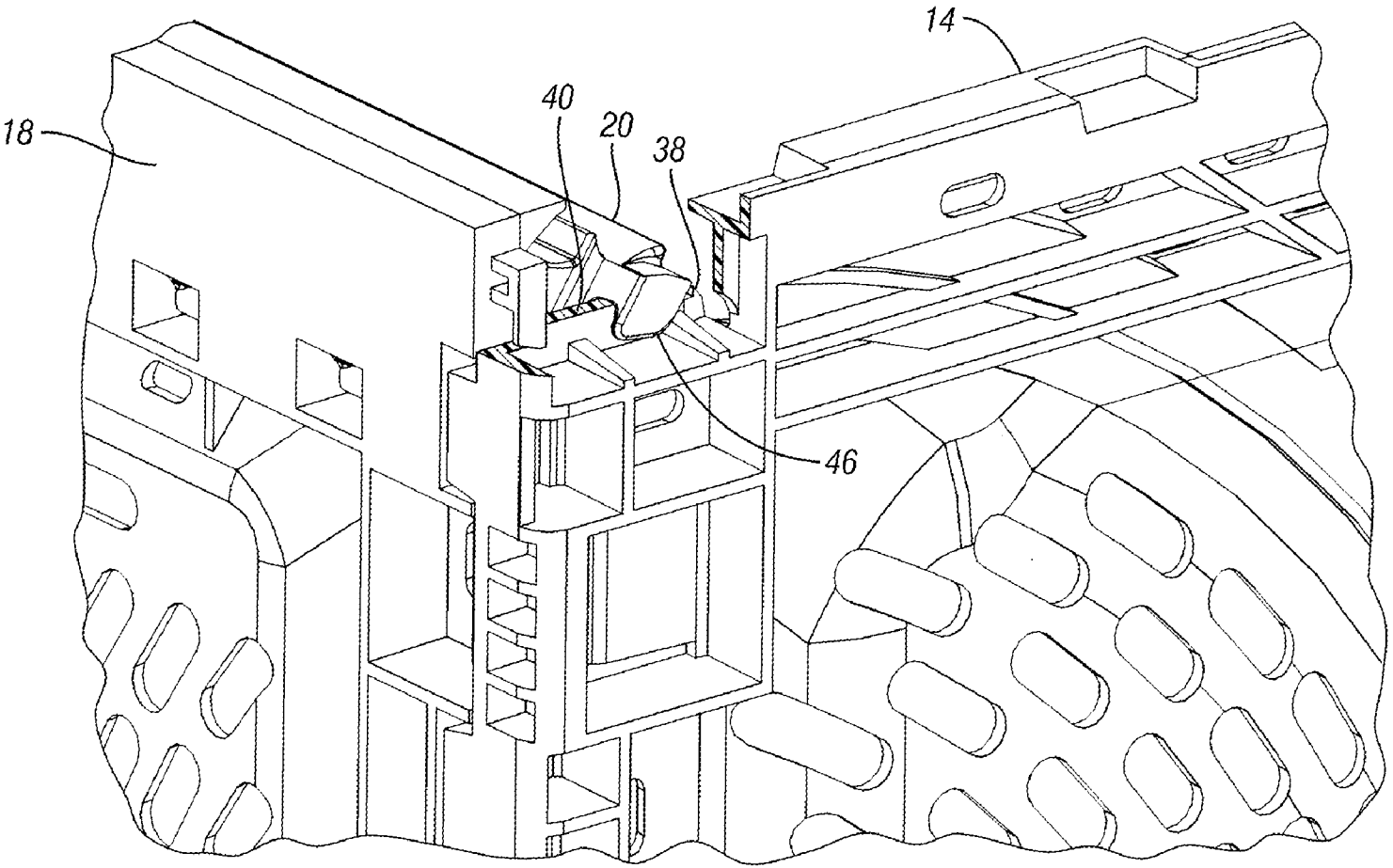
FIG. 6 is similar to FIG. 5, with the upper portion of the side wall broken away and with the support being moved from the support position toward the retracted position.
Figure 7:
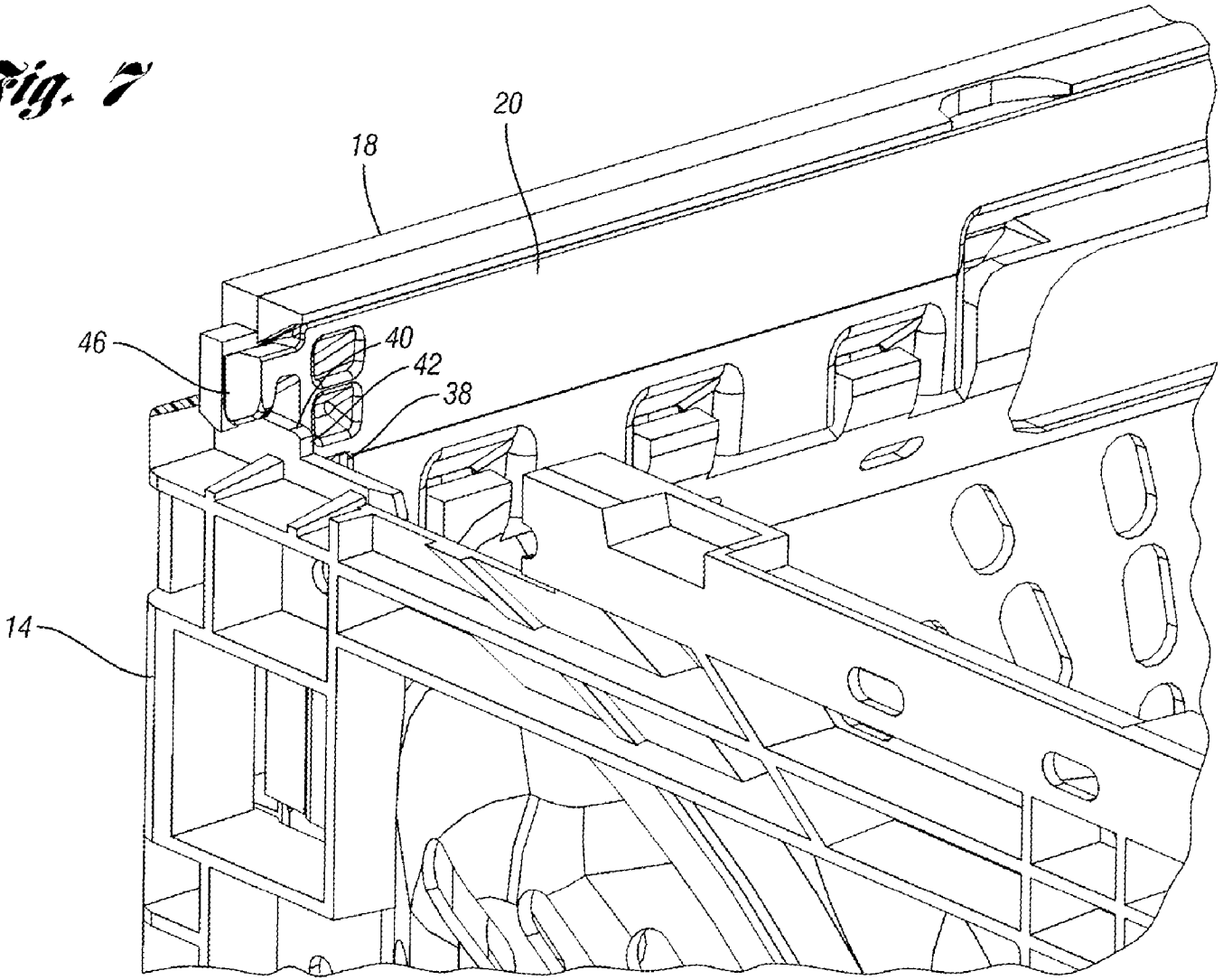
FIG. 7 illustrates the support in the retracted position, with a portion of the side wall broken away.

FIG. 4 illustrates the support 20 (partially broken away) in the support position, with the tab 21 resting on the rail 38 and abutting the step 40, which prevents the support 20 from being moved into the retracted position. As shown in FIG. 5, the support 20 includes a flange 46 extending downwardly from the tab 21 behind (that is, toward the exterior of) the rail 38. In the support position, the support 20 is prevented from retracting by the face 42 of the step 40 on the rail 38. The hinge connection between the support 20 and the end wall 18 includes sufficient tolerance for the support 20 to be lifted over and onto the step 40 by the user, as shown in FIG. 6. In this manner, the support 20 can be intentionally moved into the retracted position when desired, as shown in FIG. 7. In fact, the natural movement of the support 20 being moved toward the retracted position tends to lift the support 20 over the step 40, so no additional effort is required.

Figure 8:
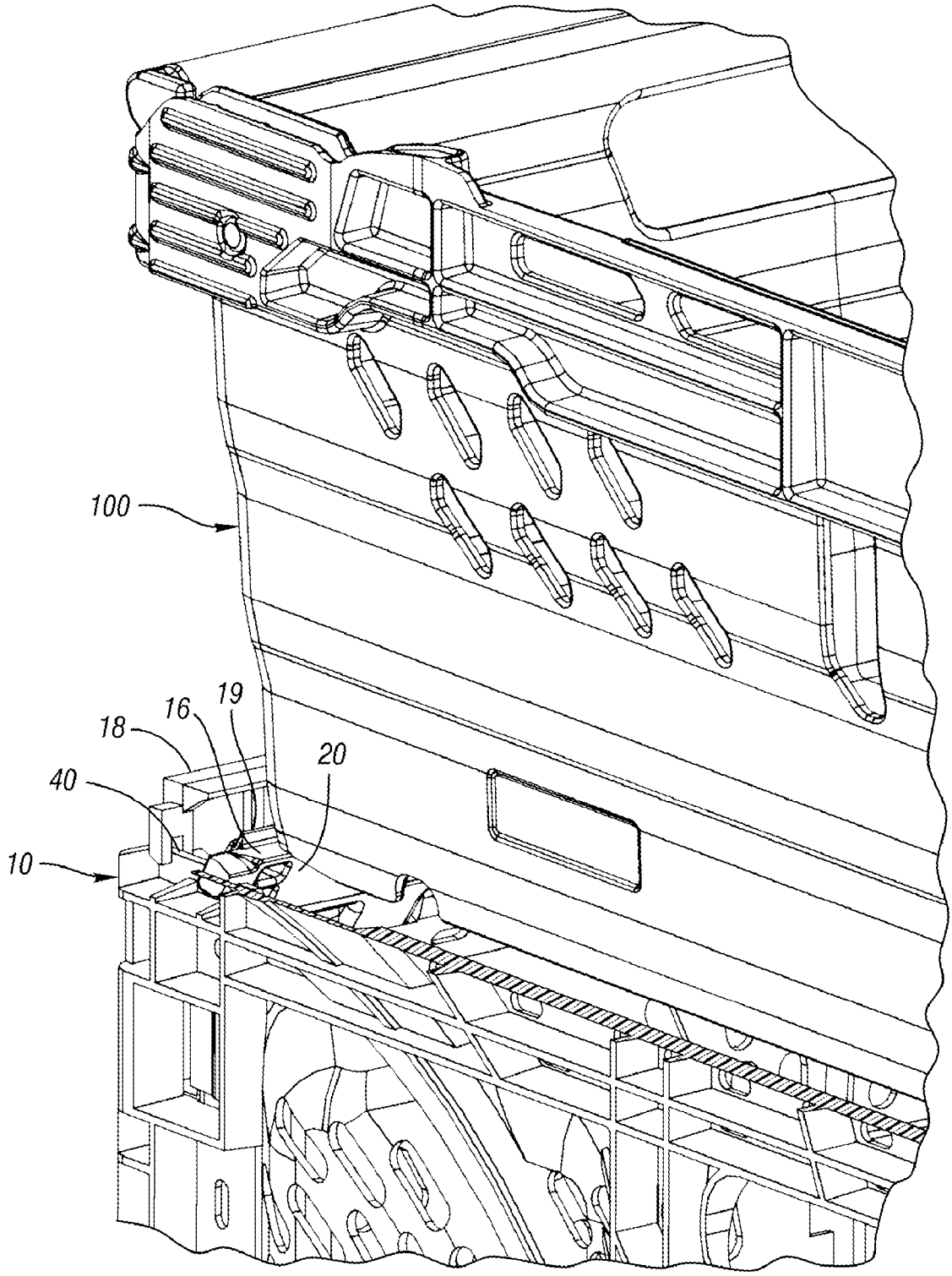
FIG. 8 illustrates the container with the support in the support position and another container supported thereon.
Figure 9:
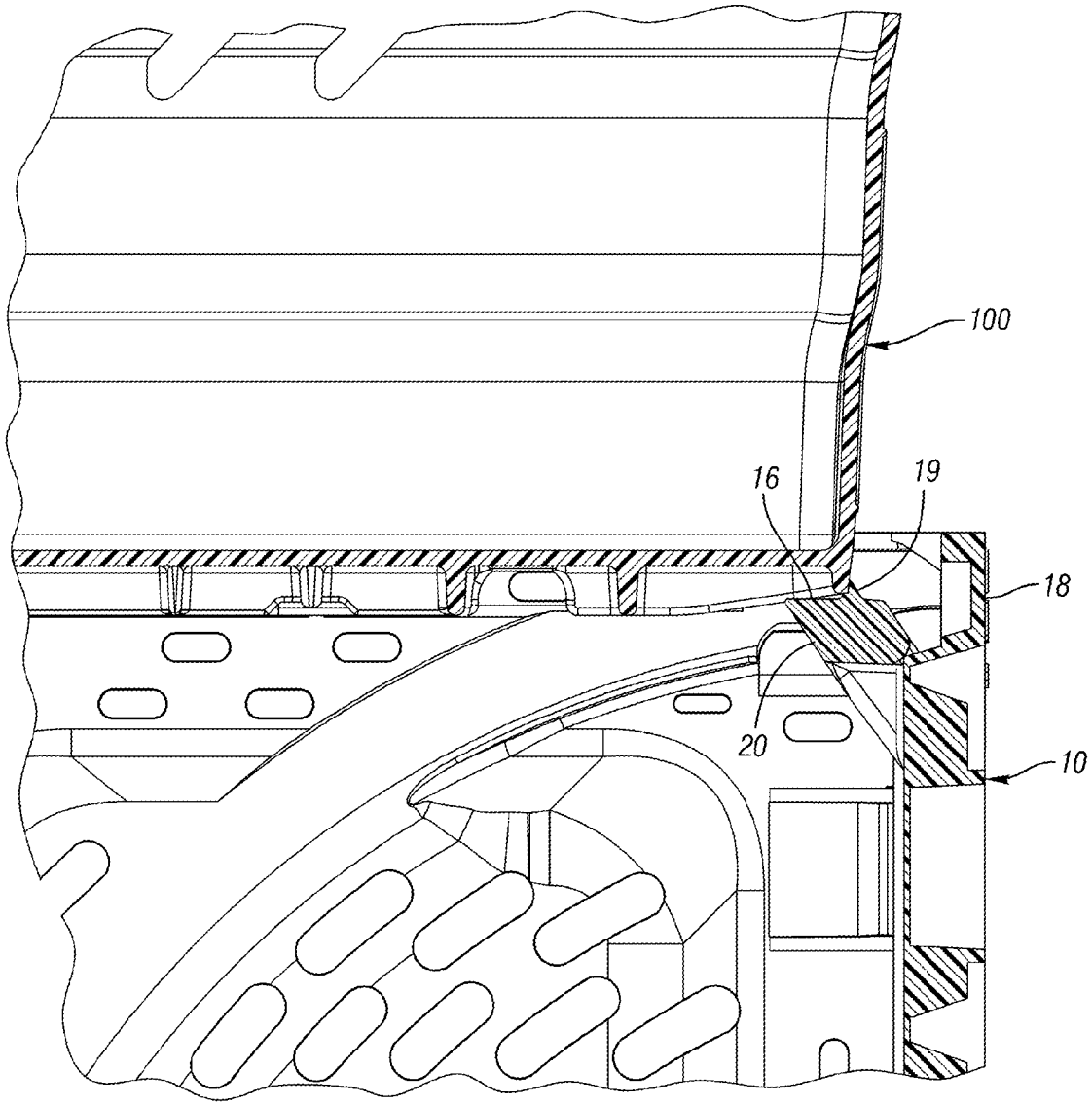
FIG. 9 is a section view through the container and upper container of FIG. 8.

However, when another container 100 is stacked on the supports 20, as shown in FIG. 8, the weight on the supports 20 keeps the supports 20 down on the rail 38, such that the step 40 prevents the supports 20 from being inadvertently knocked back into the retracted position. As also shown in FIG. 8, the back rail 19 on the upper surface 16 of the support 20 prevents the container 100 from sliding further toward the end wall 18, which could cause the opposite end of the container 100 to slide inwardly of that support 20. As shown in FIG. 9, the upper container 100 rests on the upper surface 16 of the support 20, while the back rail 19 of the support 20 locates the upper container 100 properly between the end walls 18. Although the upper container 100 is shown in contact with the back rail 19, it is anticipated that some tolerance would be permitted. This may depend upon the particular upper containers 100 with which the container 10 is to be used.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, in any of the occurrences above, the hinge members and hinge pins could be reversed and formed on opposite parts. Alphanumeric identifiers on method steps are for convenient reference in dependent claims and do not signify a required sequence of performance unless otherwise indicated in the claims.

What is claimed is:

1. A container comprising:

a base;

a first wall pivotably mounted relative to the base;

a second wall pivotably mounted relative to the base, adjacent the first wall;

a support pivotably mounted to the first wall, the support pivotable about an axis generally parallel to the base between a support position and a retracted position, the support supported by the second wall in the support position, the second wall including a stop preventing the support from being moved from the support position to the retracted position; and wherein the support is received in the first wall in the retracted position.

2. The container of claim 1 wherein the support is movable from the support position to the retracted position after being lifted relative to the first wall over the stop.

3. The container of claim 2 wherein the support includes a support portion for supporting another container thereon such that the support extends from the pivot axis to the support portion.

4. The container of claim 2 wherein the pivot axis of the support moves in response to the support being lifted.

5. The container of claim 1 wherein the stop prevents the support from being moved from the support position to the retracted position when another container is stacked on the support.

6. The container of claim 5 wherein the support moves into the interior of the container from the retracted position to the support position.

7. The container of claim 1 wherein the support includes a tab supported on a rail on the second wall in the support position.

8. The container of claim 7 wherein the support includes a flange extending downwardly behind the rail in the support position.

9. The container of claim 1 wherein the support includes a back rail on an upper surface when the support is in the support position.

10. The container of claim 9 wherein the back rail extends substantially across an entire length of the support.

11. A container comprising:

a base;

a first wall pivotably mounted relative to the base; and a second wall pivotably mounted relative to the base, adjacent the first wall;

a support movably mounted to the first wall, the support movable between a support position and a retracted position, the support supported by a rail on the second wall in the support position, the rail including a stop preventing the support from being moved from the support position to the retracted position; and wherein the support is received in the first wall in the retracted position.

12. The container of claim 11 wherein the stop includes a substantially vertically contact face abutting the support when the support is in the support position.

13. The container of claim 11 wherein the support includes a laterally extending tab supported on the rail in the support position.

14. The container of claim 13 wherein the support includes a flange extending downwardly from the tab behind the rail in the support position.

15. The container of claim 14 wherein the support includes a back rail extending upwardly from an upper surface of the support.

16. A container comprising:

a base;

a first wall pivotably mounted relative to the base;

a second wall pivotably mounted relative to the base, adjacent the first wall; and a support pivotably mounted to the first wall, the support pivotable about an axis generally parallel to the base between a support position and a retracted position, the support supported by the second wall in the support position, the support including a rail protruding upwardly from an upper surface of the support in the support position, the second wall including a stop preventing the support from being moved from the support position to the retracted position.

17. The container of claim 16 wherein the rail extends across substantially an entire length of the support.

18. A method of collapsing a container including the steps of:

a) lifting a support relative to a first wall, to which the support is pivotably mounted about a pivot axis, over a stop on an adjacent second wall such that the pivot axis moves relative to the first wall;

b) after said step a), moving the support into a retracted position at least partially in the first wall; and c) pivoting the first wall and the second wall downwardly onto the base to a collapsed position.

19. The method of claim 18 wherein said step c) includes the step of pivoting the first wall onto the base before pivoting the second wall onto the first wall.

* * * * *